US008259037B2

(12) United States Patent
Yang et al.

(10) Patent No.: US 8,259,037 B2
(45) Date of Patent: Sep. 4, 2012

(54) PLASMA DISPLAY AND DRIVING APPARATUS THEREOF

(75) Inventors: Jin-Ho Yang, Suwon-si (KR); Hyung-Jun An, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 793 days.

(21) Appl. No.: 12/332,114

(22) Filed: Dec. 10, 2008

(65) Prior Publication Data

US 2009/0315811 A1 Dec. 24, 2009

Related U.S. Application Data

(60) Provisional application No. 61/073,675, filed on Jun. 18, 2008.

(51) Int. Cl.
*G09G 3/28* (2006.01)

(52) U.S. Cl. ..... 345/60; 345/55; 345/99; 345/100

(58) Field of Classification Search ..... None
See application file for complete search history.

(56) References Cited

U.S. PATENT DOCUMENTS

| | | | | |
|---|---|---|---|---|
| 5,943,030 | A | 8/1999 | Minamibayashi | |
| 6,862,009 | B2 * | 3/2005 | Park | 345/67 |
| 7,379,033 | B2 * | 5/2008 | Lee et al. | 345/60 |
| 2003/0085886 | A1 | 5/2003 | Ide et al. | |
| 2007/0085768 | A1 | 4/2007 | Park | |
| 2007/0268216 | A1 | 11/2007 | Arai et al. | |

FOREIGN PATENT DOCUMENTS

| | | |
|---|---|---|
| KR | 2001-0083658 | 9/2001 |
| KR | 2003-0000107 | 1/2003 |
| KR | 10-2007-0120081 | 12/2007 |
| KR | 10-2008-0006742 | 1/2008 |

OTHER PUBLICATIONS

SIPO Office action dated Nov. 10, 2010, for Chinese Patent application 200910008378.5, with English translation, 7 pages.

European Search Report dated Sep. 22, 2009, for corresponding European application 09251225.0, noting listed references in this IDS.

Korean Patent Abstracts, Publication 1020010083658 A, Published Sep. 1, 2001, for Choi, et al.

Korean Patent Abstracts, Publication 1020030000107 A, Published Jan. 6, 2003, for Lim, et al.

Korean Patent Abstracts, Publication 1020070120081 A, Published Dec. 21, 2007, for Choi.

Korean Patent Abstracts, Publication 1020080006742 A, Published Jan. 17, 2008, for Kim.

* cited by examiner

*Primary Examiner* — Muhammad N Edun
(74) *Attorney, Agent, or Firm* — Christie, Parker & Hale, LLP

(57) ABSTRACT

A plasma display and a driving apparatus thereof with an improved energy recovery circuit configured to reduce resonances between a plurality of capacitors. Accordingly to an embodiment of the present invention, a plasma display has an energy recovery circuit that includes an energy recovery capacitor. The energy recovery circuit is configured to form a first path between the energy recovery capacitor and a display electrode to change a voltage at the display electrode in a sustain period. The energy recovery capacitor includes a plurality of capacitors configured to be charged concurrently, and the energy recovery circuit is configured to form a second path between the plurality of capacitors. A product of an inductance formed on the second path and a capacitance formed on the second path is greater than twice a product of an inductance formed on the first path and a capacitance formed on the first path.

20 Claims, 11 Drawing Sheets

PLASMA DISPLAY AND DRIVING APPARATUS THEREOF

CROSS-REFERENCE TO RELATED APPLICATIONS

This application claims priority to and the benefit of U.S. provisional application No. 61/073,675, filed on Jun. 18, 2008, the entire content of which is incorporated herein by reference.

BACKGROUND OF THE INVENTION 1. (a) Field of the Invention

The present invention relates to a plasma display and a driving apparatus thereof.

2. (b) Description of the Related Art

A plasma display includes a display panel having a plurality of display electrodes and a plurality of discharge cells defined by the display electrodes. The display electrodes, for example, include address electrodes, scan electrodes and sustain electrodes. The plasma display displays an image by applying a sustain pulse having a high level voltage and a low level voltage alternately to a pair of display electrodes (e.g., sustain electrodes) to perform a sustain discharge for sustain-discharging a cell that is defined by the pair of display electrodes to emit light. Hereinafter, the cell will be referred to as a light emitting cell. Since a capacitive component (hereinafter referred to as "a panel capacitor") is formed by the pair of display electrodes where the sustain discharge is generated, a reactive power is generated when the high level voltage and the low level voltage are respectively applied to the pair of display electrodes. For example, to improve power efficiency or reduce power consumption, a typical plasma display may include an energy recovery circuit for reusing (or recovering) the reactive power.

The energy recovery circuit includes an energy recovery capacitor and an inductor that is electrically coupled between a panel capacitor and the energy recovery capacitor. The energy recovery circuit generates a resonance between the inductor and the panel capacitor, recovers a resonant current corresponding to a discharge in the panel capacitor to the energy recovery capacitor, and supplies the resonant current for charging the panel capacitor from the energy recovery capacitor. In order to increase the capacitance of the energy recovery capacitor, a plurality of capacitors, each having the same capacitance and coupled in parallel, may be used as the energy recovery capacitor.

However, a variation (e.g., capacitance, parasitic inductance) may exist between the plurality of capacitors coupled in parallel, or a variation may exist between parasitic inductive components that may be represented as inductors respectively coupled to the plurality of capacitors in series.

When a variation exists between the plurality of capacitors, for example between a first capacitor and a second capacitor, a resonance cycle (i.e., an inverse number of a resonance frequency) of the first capacitor and the inductor is different from a resonance cycle of the second capacitor and the inductor so that the amount of current flowing to the first capacitor and the amount of current flowing to the second capacitor may differ from each other at the end of their resonance cycles. Then, a resonance is generated again through a closed loop that is formed by the first capacitor, the parasitic inductive component coupled to the first capacitor, the second capacitor, and the parasitic inductive component coupled to the second capacitor so that a resonance current may flow through the closed loop. Even when the first and second capacitors have the same capacitance, the parasitic inductive component coupled to the first capacitor and the parasitic inductive component coupled to the second capacitor may have different inductances. In this case, the resonance cycle corresponding to the first capacitor and the inductor, and the resonance cycle corresponding to the second capacitor and the inductor become different from each other due to the variation of the parasitic inductive components so that the resonance may still occur through the closed loop.

While the resonance is being generated, the resonance cycle is proportional to a square root of the product of the capacitance of the capacitor and the inductance of the inductor in the resonance path. However, the capacitance of each of the first and second capacitors is set (or configured) to be larger than that of the panel capacitor, and the inductance of the inductor is set (or configured) to be larger than that of the parasitic inductive component in the energy recovery circuit. Therefore, a resonance cycle formed by the first and second capacitors and their parasitic inductive components in the closed loop may be similar to a resonance cycle formed by the panel capacitor and the inductor.

Therefore, the resonance current in the closed loop may reach a maximum value during a period in which the high level voltage or the low level voltage is applied (i.e., maintained) to the display electrode. Accordingly, a large resonance current is repeatedly supplied to the first and second capacitors while the period is repeated so that temperatures of the first and second capacitors may increase, thereby causing overheating of the energy recovery circuit or degradation of the first and second capacitors.

SUMMARY OF THE INVENTION

Embodiments of the present invention provide a plasma display and a driving device thereof for reducing resonances between a plurality of capacitors that form an energy recovery circuit.

According to an embodiment of the present invention, a plasma display includes a display electrode and an energy recovery circuit that includes an energy recovery capacitor. The energy recovery circuit is configured to form a first path between the energy recovery capacitor and the display electrode to change a voltage at the display electrode in a sustain period. The energy recovery capacitor includes a plurality of capacitors configured to be charged concurrently. A second path is formed between the plurality of capacitors, and a product of an inductance formed on the second path and a capacitance formed on the second path is greater than twice a product of an inductance formed on the first path and a capacitance formed on the first path.

According to an embodiment of the present invention, a plasma display includes a display electrode, a first capacitor, a second capacitor, a first inductor, a second inductor, and a switching circuit. The first capacitor has a first terminal coupled to a ground terminal and a second terminal. The second capacitor has a first terminal coupled to the ground terminal and a second terminal. The first inductor has a first terminal coupled to the second terminal of the first capacitor and a second terminal. The second inductor has a first terminal coupled to the second terminal of the second capacitor and a second terminal. The switching circuit is coupled between the display electrode and the second terminals of the first inductor and second inductor, and configured to couple the first capacitor to the display electrode via the first inductor and couple the second capacitor to the display electrode via the second inductor concurrently to increase a voltage at the display electrode in a sustain period.

According to an embodiment of the present invention, a plasma display includes a plasma display panel, a first inductor, a second inductor, a first capacitor coupled to the plasma display panel via the first inductor, and a second capacitor coupled to the plasma display panel via the second inductor. A first terminal of each of the first capacitor and the second capacitor is grounded, and a second terminal of the first capacitor is electrically coupled to a second terminal of the second capacitor via the first inductor and the second inductor. The first capacitor and the second capacitor are configured to be charged concurrently.

Accordingly to an embodiment of the present invention, a plasma display has a plurality of display electrodes and a driver for driving the plurality of display electrodes. The driver includes a first switch, a second switch, a plurality of capacitors, a plurality of first inductors, and a third switch. The first switch is coupled between a display electrode of the plurality of display electrodes and a first power source for supplying a first voltage in a sustain period. The second switch is coupled between the display electrode and a second power source for supplying a second voltage that is lower than the first voltage in the sustain period. The plurality of capacitors each have a first terminal coupled to a third power source, and the plurality of capacitors are configured to be charged concurrently. The plurality of first inductors each have a first terminal coupled to a second terminal of a corresponding one of the plurality of capacitors, and the third switch is coupled between second terminals of the plurality of first inductors and the display electrode.

According to an embodiment of the present invention, a plasma display has a plurality of display electrodes and a driver for driving the plurality of display electrodes. The driver includes a first switch, a second switch, a plurality of capacitors, a plurality of inductors, a third switch, and a fourth switch. The first switch is coupled between a display electrode of the plurality of display electrodes and a first power source for supplying a first voltage in a sustain period. The second switch is coupled between the display electrode and a second power source for supplying a second voltage that is lower than the first voltage in the sustain period. The plurality of capacitors each have a first terminal coupled to a third power source, and the plurality of capacitors are configured to be charged concurrently. The plurality of first inductors each have a first terminal coupled to a second terminal of a corresponding one of the plurality of capacitors and a second terminal. The third switch is coupled between second terminals of the plurality of first inductors and the display electrode, and the fourth switch is coupled between the second terminals of the plurality of first inductors and the display electrode.

According to an embodiment of the present invention, a plasma display has a plurality of display electrodes and a driver for driving the plurality of display electrodes The driver includes a first switch, a second switch, a plurality of capacitors, a plurality of first inductors, a plurality of second inductors, a third switch, and a fourth switch. The first switch is coupled between a display electrode of the plurality of display electrodes and a first power source for supplying a first voltage in a sustain period. The second switch is coupled between the display electrode and a second power source for supplying a second voltage that is lower than the first voltage in the sustain period. The plurality of capacitors each have a first terminal coupled to a third power source, and the plurality of capacitors are configured to be charged concurrently. The plurality of first inductors each have a first terminal coupled to a second terminal of a corresponding one of the plurality of capacitors and a second terminal. The plurality of second inductors each have a first terminal coupled to the second terminal of a corresponding one of the plurality of capacitors and a second terminal. The third switch is coupled between second terminals of the plurality of first inductors and the display electrode. The fourth switch is coupled between second terminals of the plurality of second inductors and the display electrode.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
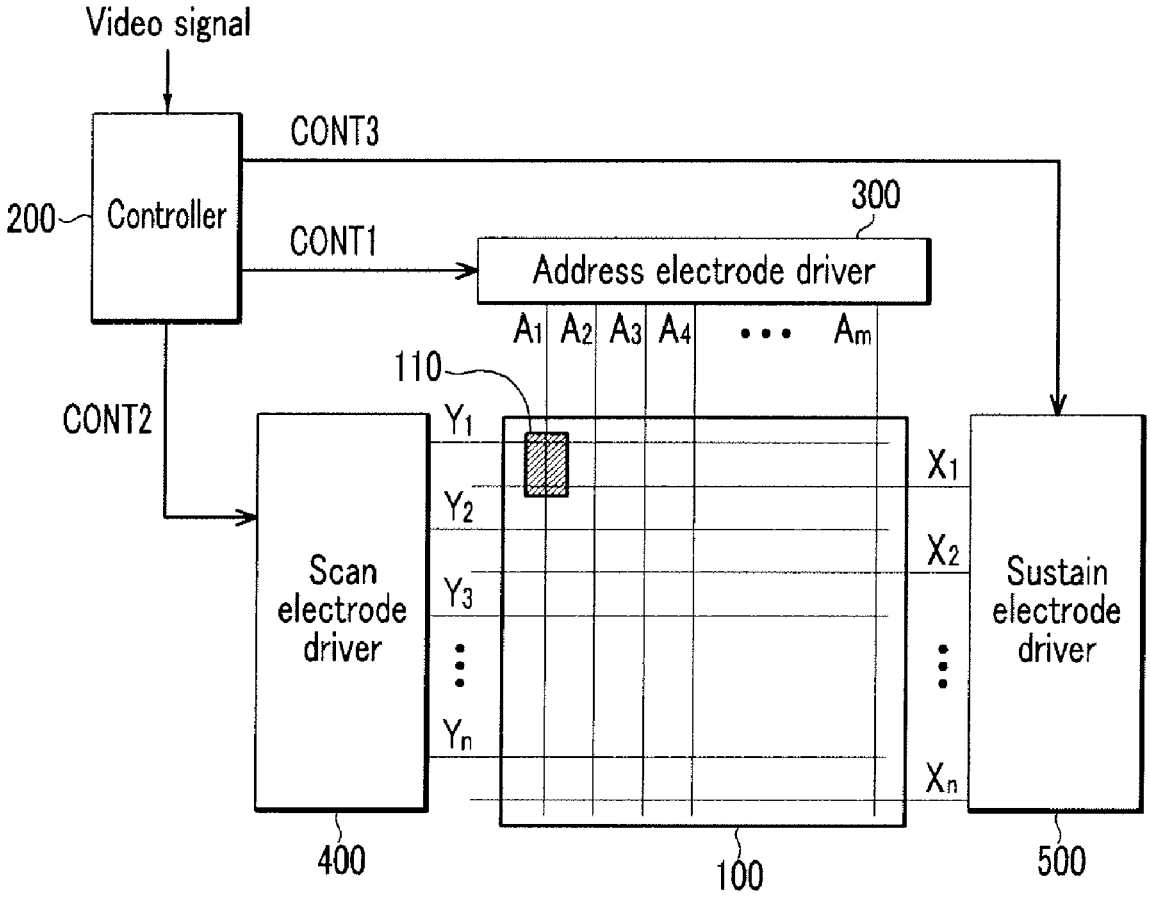
FIG. 1 is a schematic block diagram of a plasma display according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Figure 2:
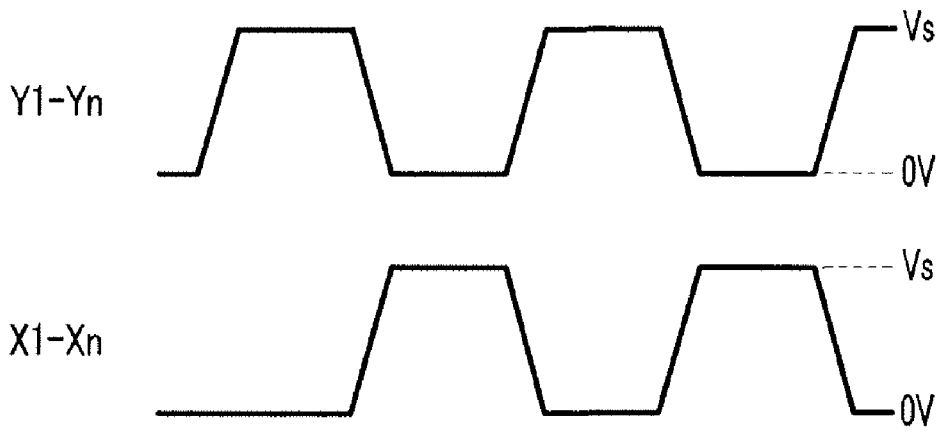
FIG. 2 and FIG. 3 are schematic drawings respectively showing driving waveforms in a sustain period of a plasma display according to an exemplary embodiment of the present invention.
Figure 3:
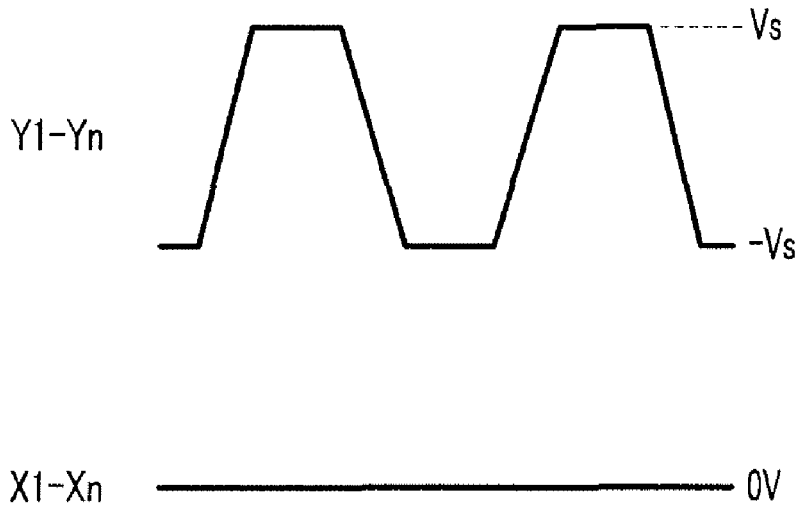

FIG. 1 is a schematic block diagram of a plasma display according to an exemplary embodiment of the present invention, and FIG. 2 and FIG. 3 respectively show driving waveforms in a sustain period of a plasma display according to an exemplary embodiment of the present invention.

Referring to FIG. 1, a plasma display includes a plasma display panel 100, a controller 200, an address electrode driver 300, a scan electrode driver 400, and a sustain electrode driver 500.

The plasma display panel 100 includes a plurality of display electrodes Y1 to Yn and X1 to Xn, a plurality of address electrodes (hereinafter referred to as "A electrodes") A1 to Am, and a plurality of discharge cells 110.

Among the plurality of display electrodes Y1 to Yn and X1 to Xn, Y1 to Yn are scan electrodes (hereinafter referred to as "Y electrodes"), and X1 to Xn are sustain electrodes (hereinafter referred to as "X electrodes"). The Y electrodes Y1 to Yn and the X electrodes X1 to Xn extend in a row direction and form substantially parallel pairs of Y and X electrodes. The A electrodes A1 to Am extend in a column direction crossing the row direction and are substantially parallel to each other. Each of the Y electrodes Y1 to Yn may correspond to one of the X electrodes X1 to Xn, or one of the Y electrodes Y1 to Yn may correspond to two of the X electrodes X1 to Xn. Here, discharge cells 110 are formed in spaces defined at the crossings of the A electrodes A1 to Am, the Y electrodes Y1 to Yn, and the X electrodes X1 to Xn.

The above-described plasma display panel 100 is only one example, and the plasma display panel 100 may have other structures according to embodiments of the present invention.

The controller 200 receives a video signal and an input control signal for controlling the display of the video signal. The video signal includes luminance information of each of the discharge cells 110, and the luminance of each of the discharge cells 110 may be represented as one of a number of gray levels. The input control signal may include a vertical synchronization signal and a horizontal synchronization signal.

The controller 200 divides one frame for displaying an image into a plurality of subfields, each of which has a luminance weight and includes an address period and a sustain period. The controller 200 processes the video signal and the input control signal based on the plurality of subfields, and generates an A electrode driving control signal CONT1, a Y electrode driving control signal CONT2, and an X electrode driving control signal CONT3. The controller 200 outputs the A electrode driving control signal CONT1 to the address electrode driver 300, the Y electrode driving control signal CONT2 to the scan electrode driver 400, and the X electrode driving control signal CONT3 to the sustain electrode driver 500.

The controller 200 changes or converts the video signal that corresponds to each of the discharge cells 110 into subfield data that indicate a light emitting/non-light emitting state of each of the discharge cells 110 in the plurality of subfields, and the A electrode driving control signal CONT1 includes the subfield data. The Y electrode driving control signal CONT2 and the X electrode driving control signal CONT3 include a sustain discharge control signal that controls the number of sustain discharge occurrences and/or sustain discharge operations in the sustain period of each subfield. In addition, the Y electrode driving control signal CONT2 further includes a scan control signal that controls a scan operation in the address period of each subfield.

The scan electrode driver 400 sequentially applies a scan voltage to the Y electrodes Y1 to Yn in the address period according to the Y electrode driving control signal CONT2. The address electrode driver 300 applies a voltage to the A electrodes A1 to Am in accordance with the A electrode driving control signal CONT1 for identifying light emitting cells and non-light emitting cells from the plurality of discharge cells 110 coupled to the Y electrodes to which the scan voltage is applied.

After the light emitting cells and the non-light emitting cells are identified in the address period, the scan electrode driver 400 and the sustain electrode driver 500 alternately apply a sustain pulse to the Y electrodes Y1 to Yn and the X electrodes X1 to Xn a number of times that correspond to a luminance weight of each subfield during the sustain period in accordance with the Y electrode driving control signal CONT2 and the X electrode driving control signal CONT3.

FIG. 2 is a schematic drawing showing driving waveforms in a sustain period of a plasma display according to an exemplary embodiment of the present invention. Referring to FIG. 2, the sustain pulses having a high level voltage Vs and a low level voltage (e.g., 0V) are alternately applied to the Y electrodes Y1 to Yn and the X electrodes X1 to Xn. When the high level voltage Vs is applied to the Y electrodes Y1 to Yn while the low level voltage is applied to the X electrodes X1 to Xn, sustain discharges occur in the discharge cells 110 due to a voltage difference between the high level voltage Vs and the low level voltage, and when the low level voltage is applied to the Y electrodes Y1 to Yn while the high level voltage Vs is applied to the X electrodes X1 to Xn, the sustain discharges occur again in the discharge cells 110 due to the voltage difference between the high level voltage Vs and the low level voltage. The above-described processes are repeated in the sustain period such that the sustain discharges occur a number of times that correspond to the luminance weight of a subfield.

FIG. 3 is a schematic drawing showing driving waveforms in a sustain period of a plasma display according to an exemplary embodiment of the present invention. Referring to FIG. 3, sustain pulses having the high level voltage Vs and a low level voltage −Vs are applied only to the Y electrodes Y1 to Yn while a suitable voltage (e.g., a predetermined voltage, 0V) is applied to the X electrodes X1 to Xn. Alternatively, the sustain pulses having the high level voltage Vs and the low level voltage −Vs may be applied only to the X electrodes X1 to Xn while a suitable voltage is applied to the Y electrodes Y1 to Yn according to an embodiment of the present invention. In this embodiment, the sustain discharges may occur in the discharge cells 110 by setting a voltage difference between the high level voltage Vs and the suitable voltage and a voltage difference between the low level voltage −Vs and the suitable voltage to be similar to the voltage difference between the high level voltage Vs and the low level voltage (e.g., 0V) of FIG. 2.

A sustain discharge circuit that generates a driving waveform (i.e., sustain pulses) in a sustain period of the plasma display will now be described in further detail with reference to FIG. 4.

Figure 4:
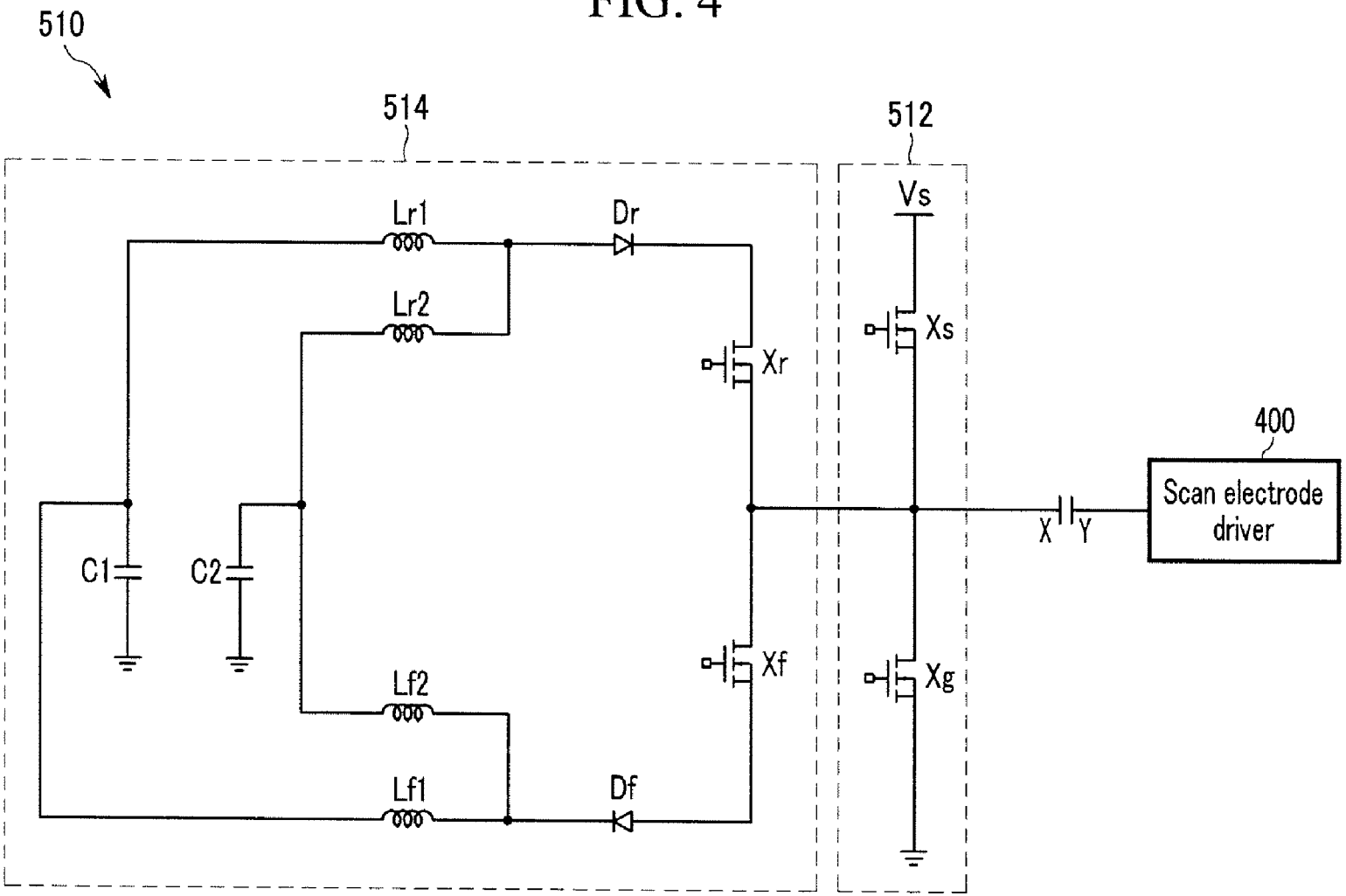
FIG. 4 is a schematic circuit diagram of a sustain discharge circuit according to an exemplary embodiment of the present invention.

FIG. 4 is a schematic circuit diagram of a sustain discharge circuit according to an exemplary embodiment of the present invention.

Referring to FIG. 4, a sustain discharge circuit 510 includes a voltage sustain unit 512 and an energy recovery circuit 514.

The sustain discharge circuit 510 may be included in the sustain electrode driver 500, and is commonly coupled to all or some of the plurality of X electrodes X1 to Xn. Alternatively, the sustain discharge circuit 510 may be included in the scan electrode driver 400, and may be commonly coupled to all or some of the plurality of Y electrodes Y1 to Yn. In FIG. 4, the sustain discharge circuit 510 is shown to be coupled to the X electrodes, and only one of the X electrodes X1 to Xn is shown. In addition, a capacitive component formed by the X electrode and the Y electrode is illustrated as a capacitor (hereinafter referred to as a "panel capacitor").

The voltage sustain unit 512 includes transistors Xs and Xg for applying the high level voltage Vs and the low level voltage, respectively, to the X electrode.

The energy recovery circuit 514 includes transistors Xr and Xf, diodes Dr and Df, a plurality of rising inductors Lr1 and Lr2, a plurality of falling inductors Lf1 and Lf2, and a plurality of capacitors C1 and C2. The energy recovery circuit 514 is operated to form a path for increasing a voltage of the X electrode or a path for decreasing the voltage of the X electrode.

Each of the transistors Xs, Xg, Xr, and Xf is a switch including a control terminal, an input terminal, and an output terminal. In FIG. 4, the transistors Xs, Xg, Xr, and Xf are respectively illustrated as an N-channel field effect transistor (FET), and in the embodiment shown in FIG. 4, the control terminal, the input terminal, and the output terminal respectively correspond to a gate, a drain, and a source. Each of the transistors Xs, Xg, Xr, and Xf may include a body diode (not shown), and an anode of the body diode is coupled to a source of a corresponding one of the transistors Xs, Xg, Xr, and Xf. A cathode of the body diode is coupled to a drain of a corresponding one of the transistors Xs, Xg, Xr, and Xf. Each of the transistors Xs, Xg, Xr, and Xf receives a control signal (not shown) for controlling their operation through their gates, and the control signal may be applied by the sustain electrode driver 500 according to the X electrode control signal CONT3.

The drain of the transistor Xs is coupled to a power source that supplies the high level voltage Vs, and the source of the transistor Xs is coupled to the X electrode. The drain of the transistor Xg is coupled to the X electrode, and the source of the transistor Xg is coupled to a power source (e.g., a ground terminal) that supplies the low level voltage.

The source of the transistor Xr is coupled to the X electrode, and the drain of the transistor Xr is coupled to a cathode of the diode Dr. The drain of the transistor Xf is coupled to the X electrode, and the source of the transistor Xf is coupled to an anode of the diode Df. In some embodiments of the present invention, the serial connection order of the transistor Xr and the diode Dr and the serial connection order of the transistor Xf and the diode Df may be switched with each other. For example, the cathode of the diode Dr may be coupled to the X electrode, the source of the transistor Xr may be coupled to the anode of the diode Dr, the anode of the diode Df may be coupled to the X electrode, and the drain of the transistor Xf may be coupled to the cathode of the diode Df.

The transistor Xr and the diode Dr form a current path for charging the panel capacitor (i.e., for increasing the voltage of the X electrode), and the transistor Xf and the diode Df form another current path for discharging the panel capacitor (i.e., for decreasing the voltage of the X electrode). That is, the transistors Xr and Xf, and the diodes Dr and Df form at least one switching circuit for increasing or decreasing the voltage of the X electrode. The diodes Dr and Df respectively block (e.g., disconnect) backward current paths that can be formed by the body diodes of the transistors Xr and Xf. In some embodiments of the present invention, the current paths are not formed in a direction from the source to the drain of the transistors Xr and Xf, therefore the diodes Dr and Df may be eliminated.

The plurality of capacitors C1 and C2 form an energy recovery capacitor, and although FIG. 4 illustrates two capacitors for ease of description, three or more capacitors may form the energy recovery capacitor. One terminal of each of the plurality of capacitors C1 and C2 is coupled to a power source that supplies a suitable low level voltage (e.g., a predetermined voltage). The plurality of capacitors C1 and C2 may store a voltage between the high level voltage Vs and the low level voltage, for example, a voltage at approximately half the voltage difference between the high level voltage Vs and the low level voltage.

One terminal of each of the rising inductors Lr1 and Lr2 is coupled to the anode of the diode Dr, another terminal of the rising inductor Lr1 is coupled to another terminal of the capacitor C1, and another terminal of the rising inductor Lr2 is coupled to another terminal of the capacitor C2. One terminal of each of the falling inductors Lf1 and Lf2 is coupled to the cathode of the diode Df, another terminal of the falling inductor Lf1 is coupled to the another terminal of the capacitor C1, and another terminal of the falling inductor Lf2 is coupled to the another terminal of the capacitor C2.

Operation of the sustain discharge circuit 510 will now be described in further detail with reference to FIG. 5 to FIG. 9.

Figure 5:
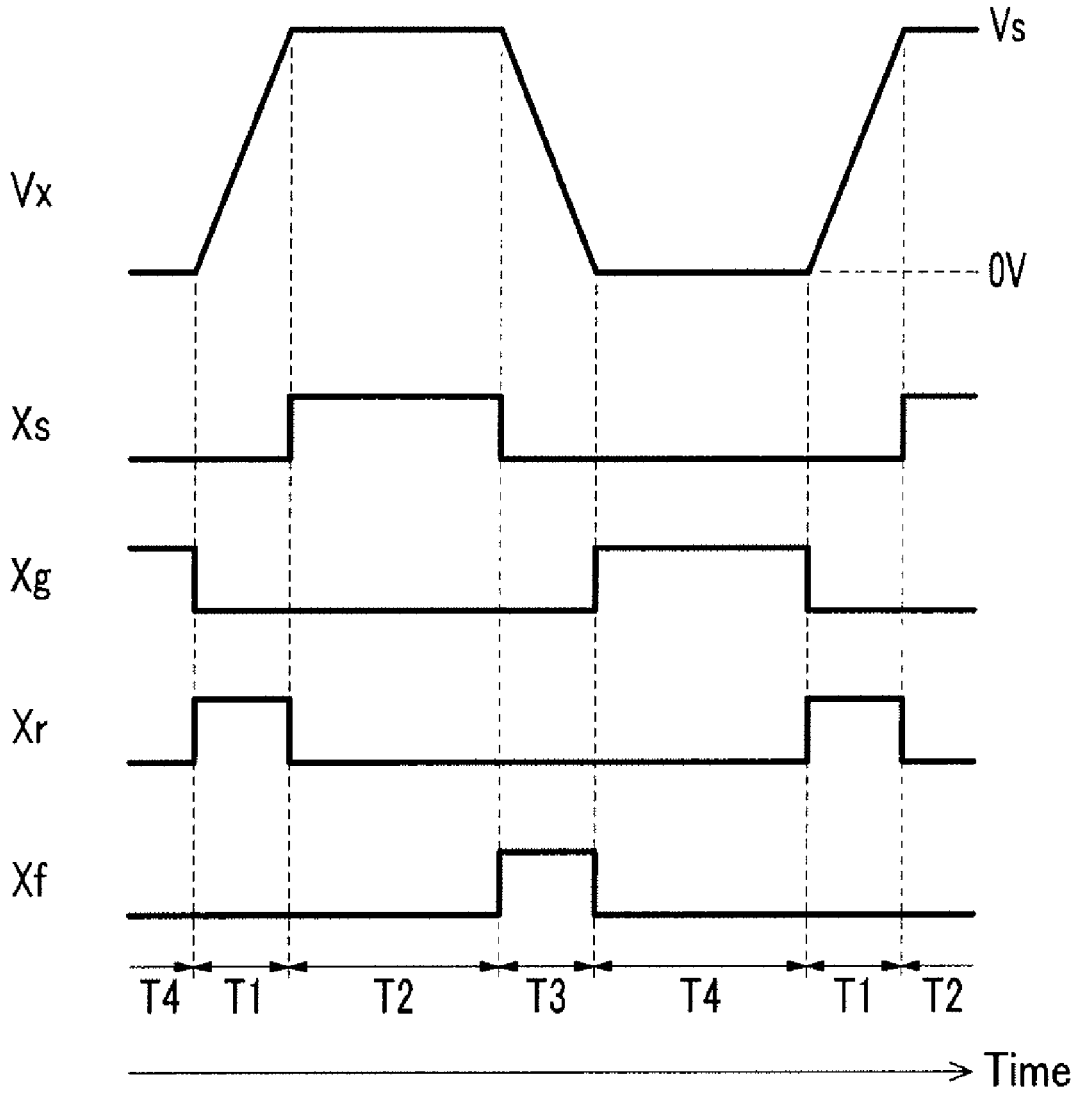
FIG. 5 is a schematic drawing showing signal timings of a sustain discharge circuit according to an exemplary embodiment of the present invention.

FIG. 5 is a schematic drawing showing signal timings of the sustain discharge circuit 510 according to an exemplary embodiment of the present invention, and FIG. 6 to FIG. 9 respectively illustrate current paths of the sustain discharge circuit 510 in each of the periods shown in FIG. 5.

In FIG. 5, voltages of the control signals respectively applied to the gate of each of the transistors Xs, Xg, Xr, and Xf are illustrated to indicate turn-on/turn-off states of the transistors Xs, Xg, Xr, and Xf. The transistors Xs, Xg, Xr, and Xf are turned on when the voltages of the control signals are at a high level and turned off when the voltages of the control signals are at a low level.

Figure 6:
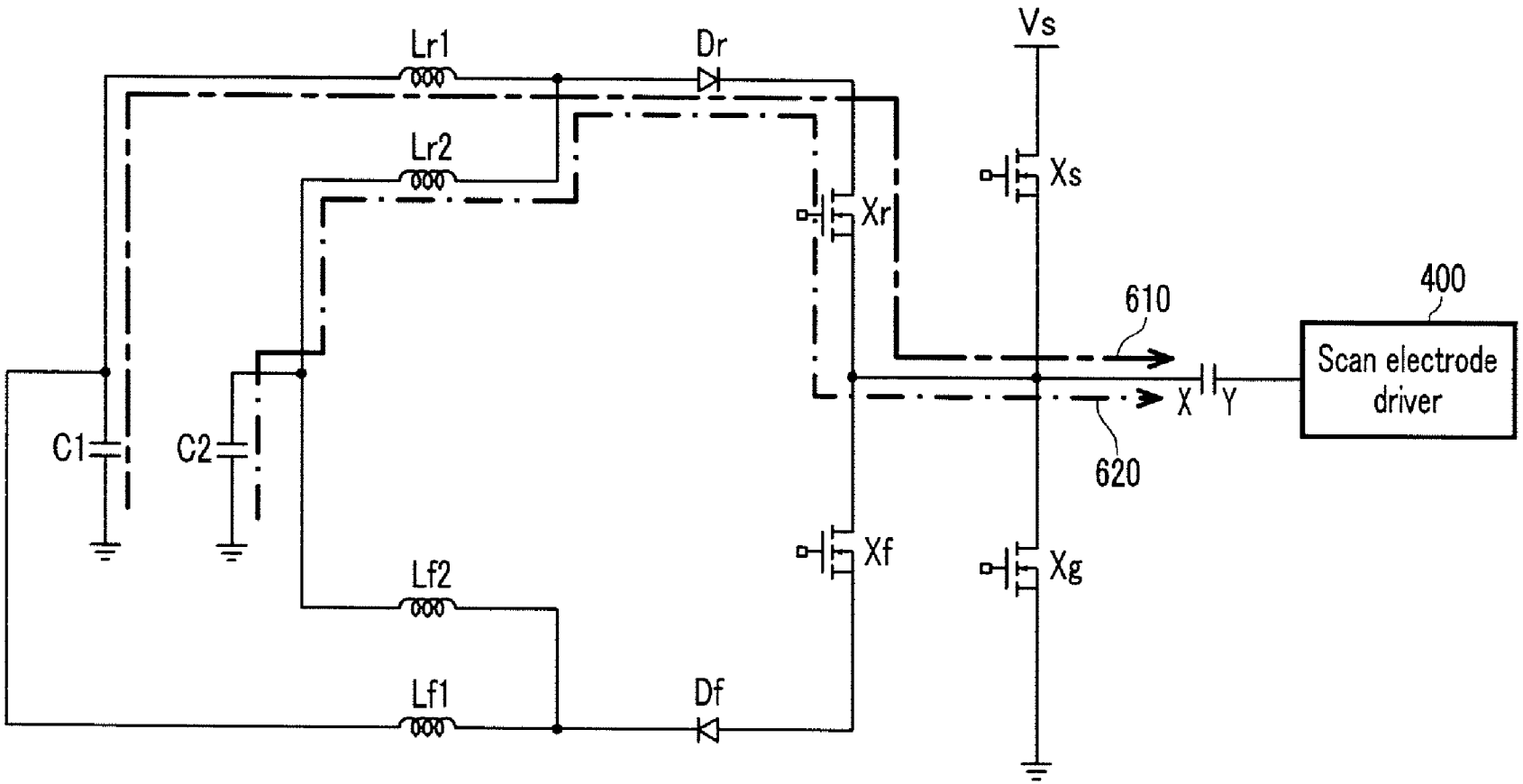
FIG. 6 to FIG. 9 are schematic circuit diagrams respectively showing a current path of the sustain discharge circuit in each of the periods shown in FIG. 5.
Figure 7:
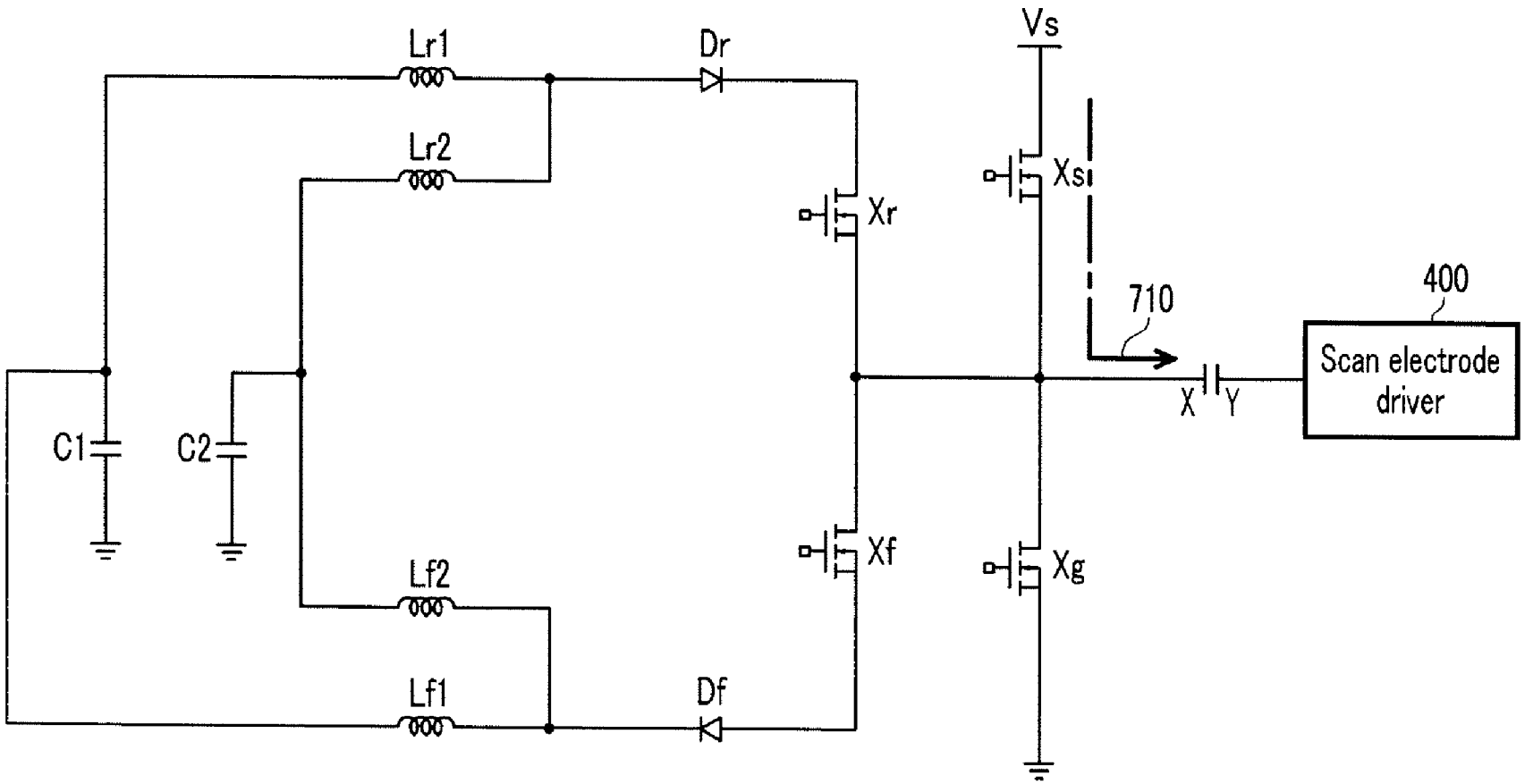

Referring to FIG. 5 and FIG. 6, in a rising period T1, the transistor Xg is turned off and the transistor Xr is turned on while the transistors Xs and Xf are turned off. Accordingly, a resonance is generated between the rising inductor Lr1 and the panel capacitor in a current path 610 that includes the capacitor C1, the rising inductor Lr1, the diode Dr, the transistor Xr, and the X electrode; and a resonance is generated between the rising inductor Lr2 and the panel capacitor in a current path 620 that includes the capacitor C2, the rising inductor Lr2, the diode Dr, the transistor Xr, and the X electrode. During the rising period T1, a voltage Vx of the X electrode is gradually increased due to the resonances. In addition, the capacitors C1 and C2 are concurrently discharged by the current paths 610 and 620.

When the voltage Vx of the X electrode almost or substantially reaches the high level voltage Vs, the transistor Xs is turned on by a high level voltage as shown in FIG. 5 so that a high level voltage maintaining period T2 begins. During the high level voltage maintaining period T2, the high level voltage Vs is applied to the X electrode through a current path 710 shown in FIG. 7 so that the voltage Vx of the X electrode is maintained at the high level voltage Vs. The transistor Xr may be turned off by a low level voltage at the starting point of or during the high level voltage maintaining period T2.

Figure 8:
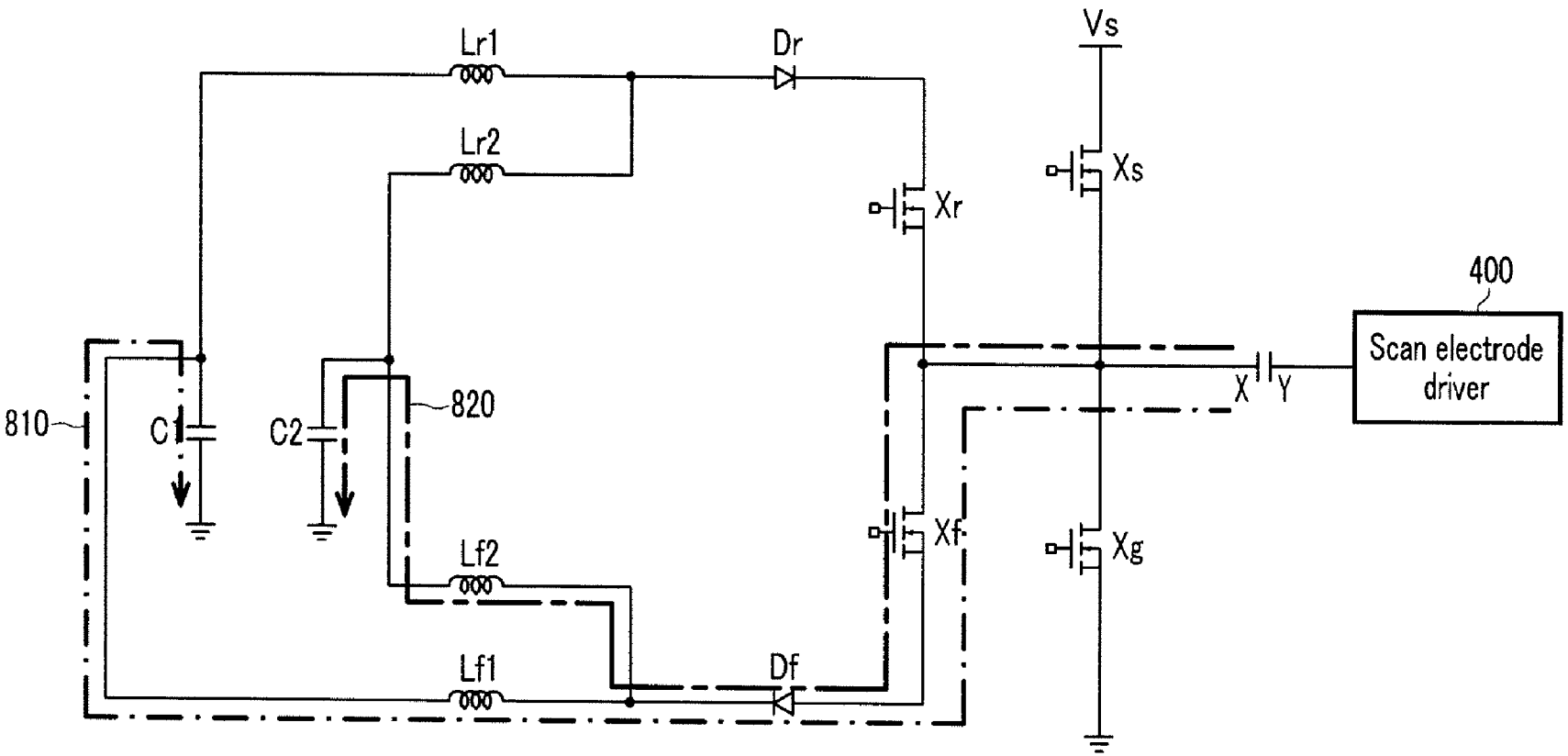
Figure 9:
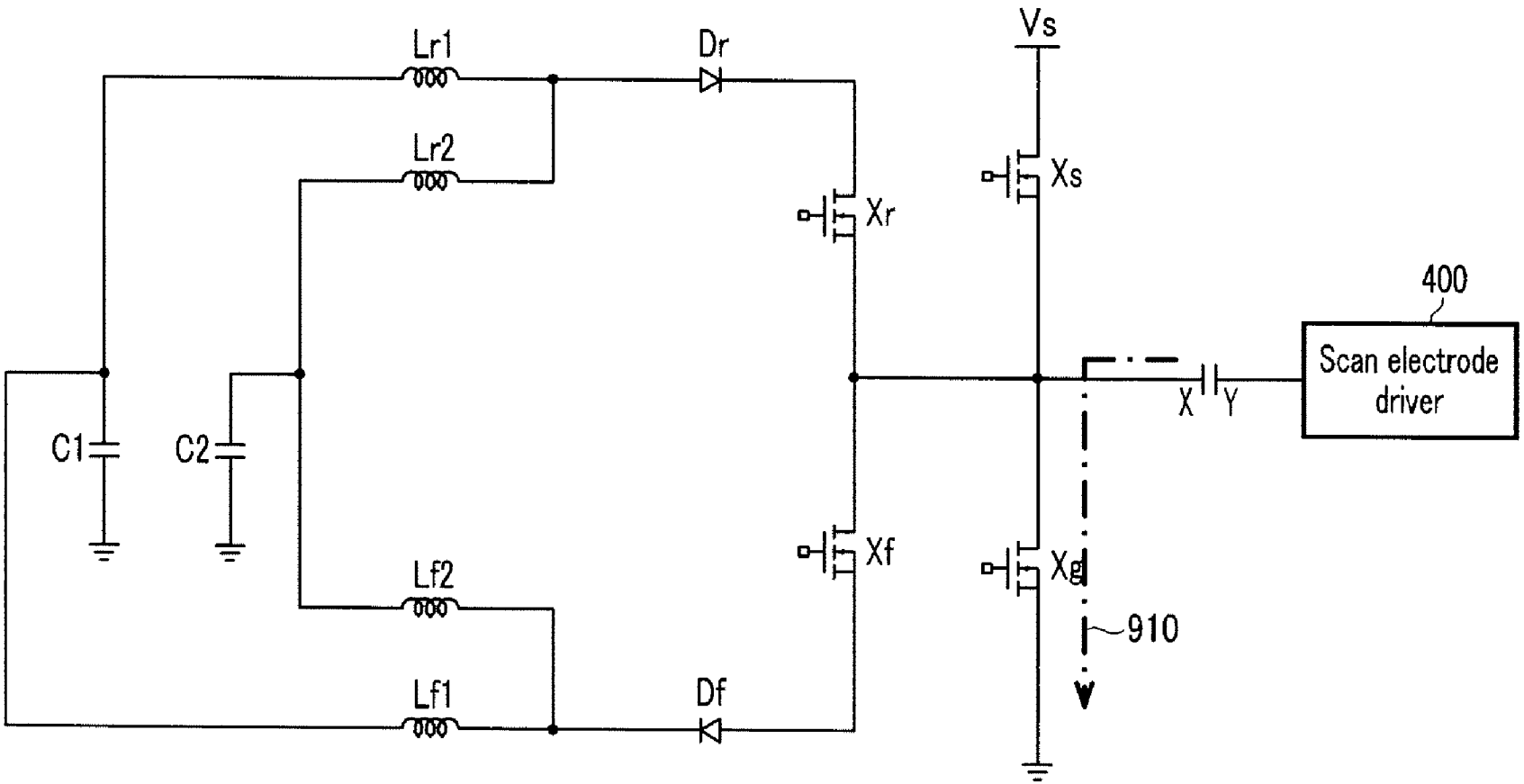

Subsequently, in a falling period T3 as shown in FIG. 5, the transistor Xs is turned off by a low level voltage, and the transistor Xf is turned on by a high level voltage. Accordingly, as shown in FIG. 8, a resonance is generated between the falling inductor Lf1 and the panel capacitor in a current path 810 that includes the X electrode, the transistor Xf, the diode Df, the falling inductor Lf1, and the capacitor C1; and a resonance is also generated between the falling inductor Lf2 and the panel capacitor in a current path 820 that includes the X electrode, the transistor Xf, the diode Df, the falling inductor Lf2, and the capacitor C2. In the falling period T3, the voltage Vx of the X electrode is gradually decreased due to the resonances generated in the current paths 810 and 820. In addition, the capacitors C1 and C2 are concurrently charged by the current paths 810 and 820.

Referring to FIG. 5, when the voltage Vx of the X electrode is decreased to be substantially close to the low level voltage, the transistor Xg is turned on by a high level voltage so that a low level voltage maintaining period T4 begins. During the low level maintaining period T4, the low level voltage is applied to the X electrode through a current path 910 shown in FIG. 9 to maintain the voltage Vx of the X electrode at the low level voltage. The transistor Xf may be turned off by a low level voltage at the starting point of or during the low level voltage maintaining period T4.

The high level voltage Vs and the low level voltage can be alternately applied to the X electrode by repeating the periods T1 to T4. In addition, the scan electrode driver 400 may apply the low level voltage to the Y electrode during the high level voltage maintaining period T2, and may apply the high level voltage Vs to the Y electrode during the low level voltage maintaining period T4.

If a variation exists between capacitances of the two capacitors C1 and C2 or between parasitic inductive components of the two capacitors C1 and C2, a resonance cycle in the current path 610 may be different from a resonance cycle in the current path 620. The current supplied to the X electrode in the rising period T1 is a sum of the currents supplied from the two capacitors C1 and C2, however, the sum of the currents may include a current that flows to the capacitor C1 and a current that flows from the capacitor C2 even though the current supplied to the X electrode at the finishing point of the rising period T1 is substantially 0 A. In the high level voltage maintaining period T2, a resonance path may be formed through a closed loop that includes the capacitor C1, the rising inductors Lr1 and Lr2, and the capacitor C2 even though the resonances between the panel capacitor and the rising inductors Lr1 and Lr2 are terminated.

Capacitance of each of the capacitors C1 and C2 is set to be suitably large so that the capacitance of the panel capacitor can be ignored when the capacitors C1 and C2 are operated as a source for supplying a constant voltage in the sustain discharge circuit 510. A capacitive component that forms the resonance in each of the current paths 610 and 620 in the rising period T1 is determined by the capacitance of the panel capacitor, and a capacitive component that forms the resonance in the closed loop is determined by the capacitances of the capacitors C1 and C2. Since a resonance cycle T in a resonance path is proportional to a square root of the product of the capacitance C of a capacitor and the inductance L of an inductor that form the resonance path as given in Equation 1, the resonance cycle T in the closed loop is much longer than the resonance cycle T in each of the current paths 610 and 620 in the rising period T1.

$$T=2\pi\sqrt{LC} \qquad \text{Equation 1}$$

In some embodiments according to the present invention, the resonance cycle T of the closed loop is greater than twice the resonance cycle of a rising resonance path, e.g., current paths 610 and 620. The resonance cycle T of the closed loop is a product of an inductance and a capacitance formed on the closed loop, and the resonance cycle T of the rising resonance path is a product of an inductance and a capacitance formed on the rising resonance path. For example, the LC term of Equation 1 can be represented as (Lr1+Lr2)C1C2/(C1+C2) for the closed loop, and represented as [(Lr1Lr2)/(Lr1+Lr2)](Cp) for the rising resonance path, where Cp represents the panel capacitor, when the inductance of the parasitic inductive component of each of the capacitors C1 and C2 is sufficiently small compared to each of the inductance Lr1 and Lr2. Assuming the inductance Lr1 is approximately equal to the inductance Lr2 and the capacitance C1 is approximately equal to the capacitance C2, the LC term can be represented as Lr1C1 for the closed loop, and represented as Lr1Cp/2 for the rising resonance path. Since the capacitance C1 is greater than capacitance Cp, the LC term of the closed loop is greater than twice the LC term of the rising resonance path.

In an exemplary embodiment of the present invention, the panel capacitor has a capacitance of 100 NF, each of the capacitors C1 and C2 has a capacitance of 2.2 uF, and each of the inductors Lr1 and Lr2 has an inductance of 0.6 uH, and it is assumed that the inductance of the parasitic inductive component of each of the capacitors C1 and C2 is sufficiently small compared to the inductance of each of the inductors Lr1 and Lr2. In this embodiment, the resonance cycle T in each of the current paths 610 and 620 in the rising period T1 becomes approximately 1 us, and the resonance cycle T in the closed loop that includes the capacitor C1, the rising inductors Lr1 and Lr2, and the capacitor C2 becomes approximately 5 us.

As described above, since the resonance cycle T in the closed loop (e.g., in the period T2) is longer than the resonance cycle T in the rising period T1, the resonance current does not reach a maximum value during the high level voltage maintaining period T2. Therefore, the resonance current is at a suitably small value to prevent the temperature of each of the capacitors C1 and C2 from being increased even though the resonance may be generated through the closed loop.

Furthermore, a resonance path may be formed through the closed loop that includes the capacitor C1, the falling inductors Lf1 and Lf2, and the capacitor C2 at the finishing point of the falling period T3; therefore, the temperature of each of the capacitors C1 and C2 may be prevented from being increased since the closed loop has a long resonance cycle.

In the sustain discharge circuit of FIG. 4, the high level voltage is set to the Vs voltage, and the low level voltage is set to 0V in order to generate the sustain pulse of FIG. 2. In some embodiments of the present invention, the high level voltage may be set to the Vs voltage, and the low level voltage may be set to the −Vs voltage for generating the sustain pulse on the Y electrodes Y1-Yn as shown in FIG. 3.

Sustain discharge circuits according to other exemplary embodiments of the present invention will now be described in further detail with reference to FIG. 10 to FIG. 12.

Figure 10:
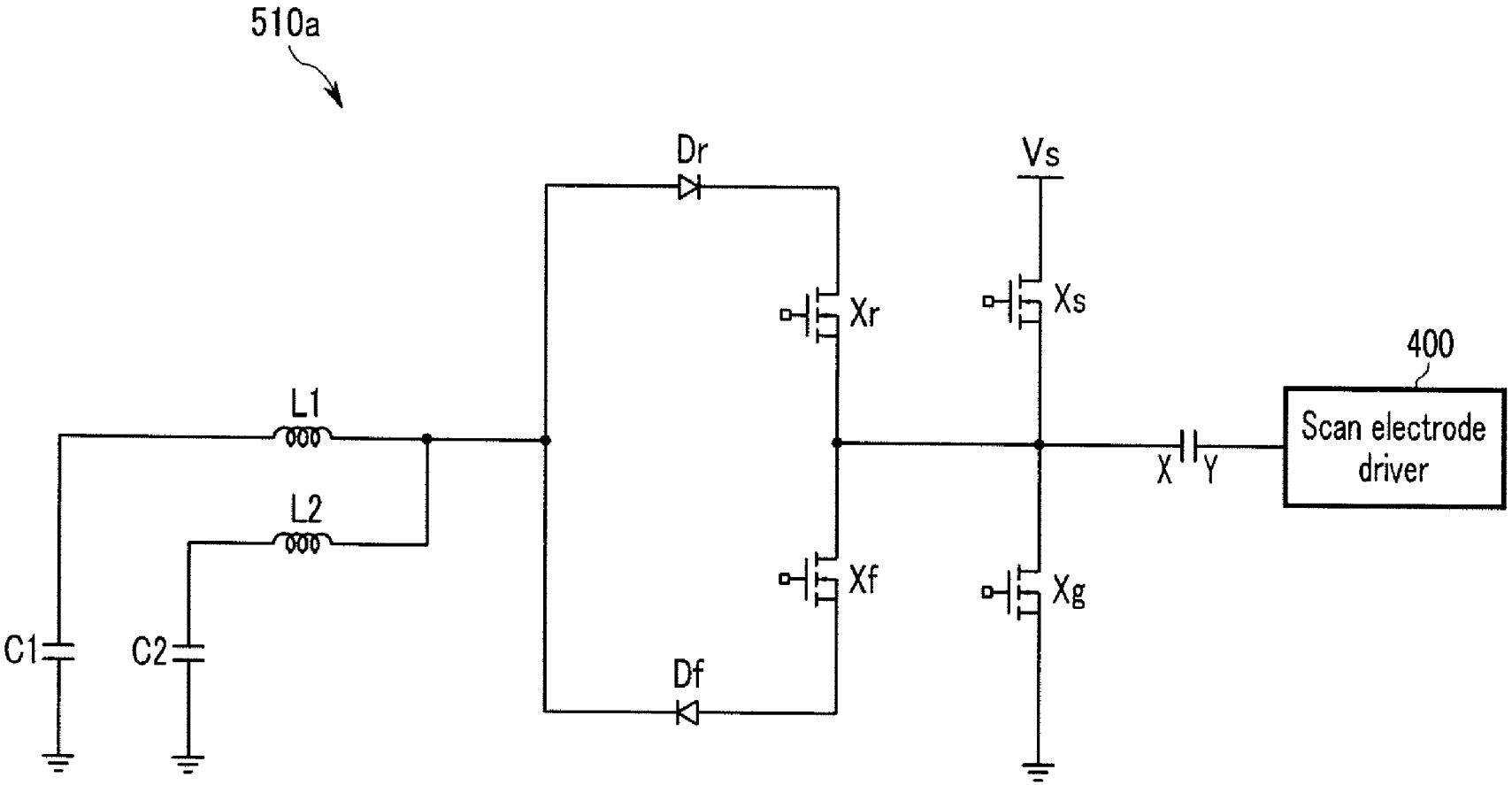
FIG. 10 to FIG. 12 are schematic circuit diagrams respectively showing circuit diagrams of sustain discharge circuits according to other exemplary embodiments of the present invention.
Figure 11:
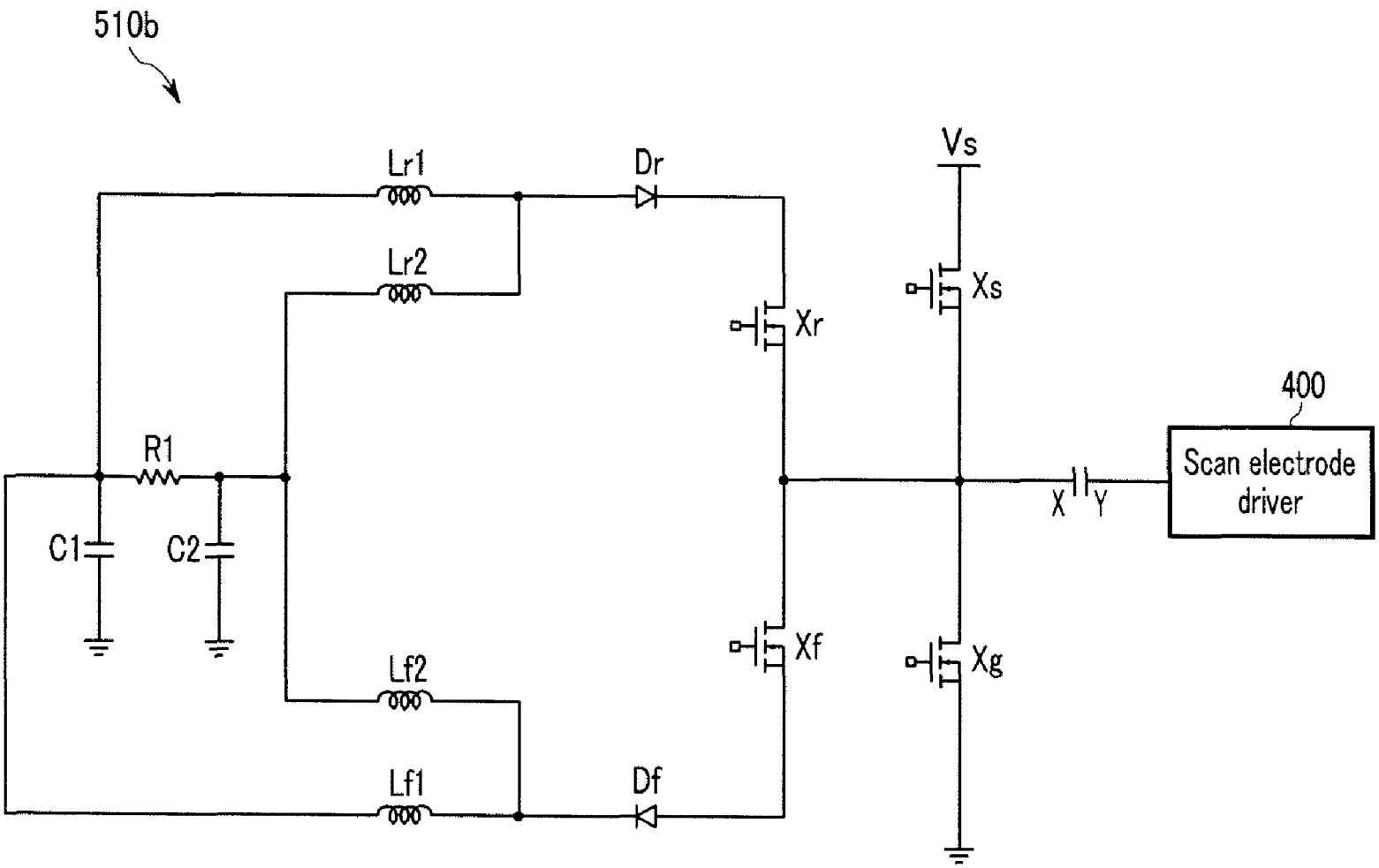
Figure 12:
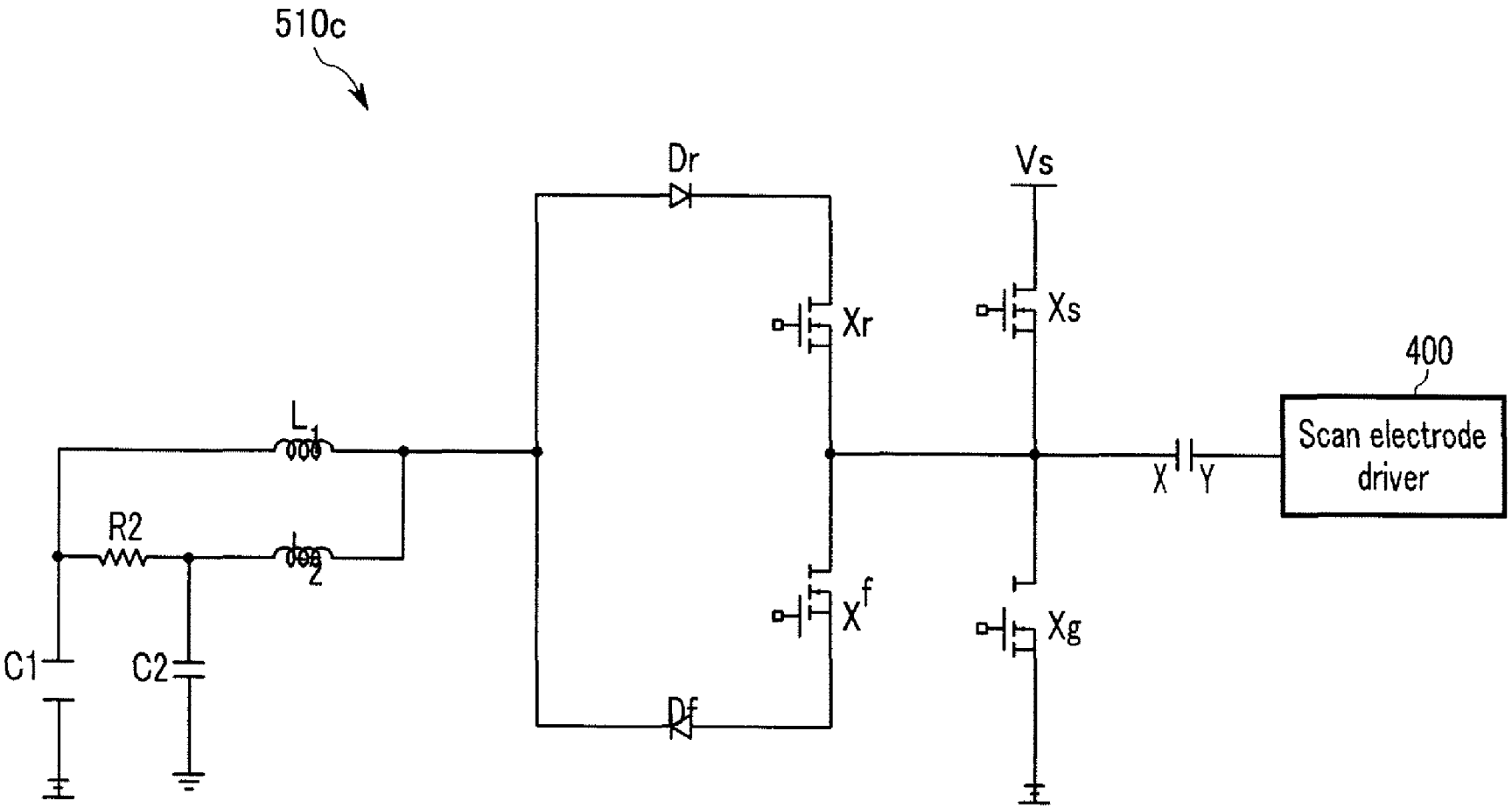

FIG. 10 to FIG. 12 are schematic drawings that respectively illustrate circuit diagrams of sustain discharge circuits according to other exemplary embodiments of the present invention.

Referring to FIG. 10, in a sustain discharge circuit 510*a* according to an exemplary embodiment of the present invention, the rising inductor (e.g., Lr1 and Lr2 of FIG. 4) and the falling inductor (e.g., Lf1 and Lf2 of FIG. 4) may be respectively integrated into single inductors (e.g., L1 and L2). That is, a first terminal of each of the inductors L1 and L2 is commonly coupled to the anode of the diode Dr and the cathode of the diode Df. First terminals of the capacitors C1 and C2 are coupled to a ground terminal. A second terminal of the inductor L1 is coupled to a second terminal of the capacitor C1, and a second terminal of the inductor L2 is coupled to a second terminal of the capacitor C2. Accordingly, a current path formed in the rising period T1 and a current path formed in the falling period T3 can both be formed through the inductors L1 and L2 as shown in FIG. 10.

Referring to FIG. 11, in a sustain discharge circuit 510*b* according to an exemplary embodiment of the present invention, a resistor R1 may be coupled between the second terminals of the capacitors C1 and C2. As such, when a resonance path is formed by the capacitors C1 to C2 in the high level voltage maintaining period T2, the resonance path is formed in a parallel resonance circuit where the resistor R1 and the rising inductors Lr1 and Lr2 are coupled in parallel between the capacitors C1 and C2. When a resonance path is formed by the capacitors C1 and C2 in the low level voltage maintaining period T4, the resonance path is formed in a parallel resonance circuit where the resistor R1 and the falling inductors Lf1 and Lf2 are coupled in parallel between the capacitors C1 and C2. Therefore, the resonance current is dispersed through the parallel resonance circuit, and the amount of resonance current flowing to the capacitors C1 and C2 during the high level voltage maintaining period T2 and the low level voltage maintaining period T4 may be reduced.

FIG. 12 is a schematic diagram showing a sustain discharge circuit 510*c*. In the sustain discharge circuit 510*c*, the rising inductor (e.g., Lr1 and Lr2 of FIG. 4) and the falling inductor (e.g., Lf1 and Lf2 of FIG. 4) are respectively integrated into single inductors (e.g., L1 and L2), and a resistor R2 are coupled between the second terminals of the capacitors C1 and C2. As such, when a resonance path is formed by the capacitors C1 to C2 in the high level voltage maintaining period T2, the resonance path is formed in a parallel resonance circuit where the resistor R2 and the inductors L1/L2 are coupled in parallel between the capacitors C1 and C2. When a resonance path is formed by the capacitors C1 and C2 in the low level voltage maintaining period T4, the resonance path is formed in a parallel resonance circuit where the resistor R2 and the inductors L1/L2 are coupled in parallel between the capacitors C1 and C2. Therefore, the resonance current is dispersed through the parallel resonance circuit, and the amount of resonance current flowing to the capacitors C1 and C2 during the high level voltage maintaining period T2 and the low level voltage maintaining period T4 may be reduced.

As described above, according to the exemplary embodiments of the present invention, direct parallel connection between a plurality of capacitors that form an energy recovery circuit may be prevented by using an inductor, and accordingly, the amount of a resonance current that may be generated due to a variation between each of the plurality of capacitors can be reduced.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display comprising:

a display electrode; and an energy recovery circuit comprising an energy recovery capacitor, and configured to form a first path between the energy recovery capacitor and the display electrode to change a voltage at the display electrode in a sustain period, wherein the energy recovery capacitor comprises a plurality of capacitors configured to be charged concurrently, wherein a second path is formed between the plurality of capacitors, and wherein a product of an inductance formed on the second path and a capacitance formed on the second path is greater than twice a product of an inductance formed on the first path and a capacitance formed on the first path.

2. The plasma display of claim 1, wherein the energy recovery circuit further comprises a plurality of inductors each having one terminal coupled to one terminal of a corresponding one of the plurality of capacitors, and wherein the second path comprises the plurality of capacitors and the plurality of inductors.

3. The plasma display of claim 2, wherein another terminal of each of the plurality of capacitors is coupled to a ground terminal.

4. A plasma display comprising:

a display electrode;

a first capacitor having a first terminal coupled to a ground terminal and a second terminal;

a second capacitor having a first terminal coupled to the ground terminal and a second terminal;

a first inductor having a first terminal coupled to the second terminal of the first capacitor and a second terminal;

a second inductor having a first terminal coupled to the second terminal of the second capacitor and a second terminal; and a switching circuit coupled between the display electrode and the second terminals of the first inductor and second inductor, and configured to couple the first capacitor to the display electrode via the first inductor and couple the second capacitor to the display electrode via the second inductor concurrently to increase a voltage at the display electrode in a sustain period.

5. The plasma display of claim 4, wherein the switching circuit is configured to form a first current path from the first capacitor to the display electrode via the first inductor, and a second current path from the second capacitor to the display electrode via the second inductor to increase the voltage at the display electrode, and wherein the switching circuit is configured to form a third current path from the display electrode to the first capacitor via the first inductor, and a fourth current path from the display electrode to the second capacitor via the second inductor to decrease the voltage at the display electrode.

6. The plasma display of claim 5, wherein the switching circuit is configured to concurrently form the first current path and the second current path when increasing the voltage at the display electrode, and wherein the switching circuit is configured to concurrently form the third current path and the fourth current path when decreasing the voltage at the display electrode.

7. The plasma display of claim 5, further comprising:

a third inductor having a first terminal coupled to the second terminal of the first capacitor and a second terminal;

a fourth inductor having a first terminal coupled to the second terminal of the second capacitor and a second terminal; and another switching circuit coupled between the second terminals of the third and fourth inductors and the display electrode, and configured to couple the first capacitor to the display electrode via the third inductor and couple the second capacitor to the display electrode via the fourth inductor to change the voltage at the display electrode in the sustain period.

8. The plasma display of claim 7, wherein the switching circuit is configured to concurrently form the first current path and the second current path when increasing the voltage at the display electrode, and wherein the another switching circuit is configured to concurrently form the third current path and the fourth current path when decreasing the voltage at the display electrode.

9. A plasma display comprising:

a plasma display panel;

a first inductor;

a second inductor;

a first capacitor coupled to the plasma display panel via the first inductor; and a second capacitor coupled to the plasma display panel via the second inductor, wherein a first terminal of each of the first capacitor and the second capacitor is grounded, and a second terminal of the first capacitor is electrically coupled to a second terminal of the second capacitor via the first inductor and the second inductor, and the first capacitor and the second capacitor are configured to be charged concurrently.

10. A plasma display having a plurality of display electrodes and a driver for driving the plurality of display electrodes, the driver comprising:

a first switch coupled between a display electrode of the plurality of display electrodes and a first power source for supplying a first voltage in a sustain period;

a second switch coupled between the display electrode and a second power source for supplying a second voltage that is lower than the first voltage in the sustain period;

a plurality of capacitors each having a first terminal coupled to a third power source, the plurality of capacitors configured to be charged concurrently;

a plurality of first inductors each having a first terminal coupled to a second terminal of a corresponding one of the plurality of capacitors; and a third switch coupled between second terminals of the plurality of first inductors and the display electrode.

11. The plasma display of claim 10, further comprising a resistor coupled between the second terminal of a first capacitor among the plurality of capacitors and the second terminal of a second capacitor among the plurality of capacitors.

12. The plasma display of claim 10, wherein the third power source supplies a third voltage that is the same as the second voltage.

13. A plasma display having a plurality of display electrodes and a driver for driving the plurality of display electrodes, the driver comprising:

a first switch coupled between a display electrode of the plurality of display electrodes and a first power source for supplying a first voltage in a sustain period;

a second switch coupled between the display electrode and a second power source for supplying a second voltage that is lower than the first voltage in the sustain period;

a plurality of capacitors each having a first terminal coupled to a third power source, the plurality of capacitors configured to be charged concurrently;

a plurality of inductors each having a first terminal coupled to a second terminal of a corresponding one of the plurality of capacitors and a second terminal;

a third switch coupled between second terminals of the plurality of inductors and the display electrode; and a fourth switch coupled between the second terminals of the plurality of inductors and the display electrode.

14. The plasma display of claim 13, further comprising a resistor coupled between the second terminal of a first capacitor among the plurality of capacitors and the second terminal of a second capacitor among the plurality of capacitors.

15. The plasma display of claim 13, wherein a voltage of the display electrode increases when the third switch is turned on, and the voltage of the display electrodes decreases when the fourth switch is turned on.

16. The plasma display of claim 13, wherein the third power source supplies a third voltage that is the same as the second voltage.

17. A plasma display having a plurality of display electrodes and a driver for driving the plurality of display electrodes, the driver comprising:

a first switch coupled between a display electrode of the plurality of display electrodes and a first power source for supplying a first voltage in a sustain period;

a second switch coupled between the display electrode and a second power source for supplying a second voltage that is lower than the first voltage in the sustain period;

a plurality of capacitors each having a first terminal coupled to a third power source, the plurality of capacitors configured to be charged concurrently;

a plurality of first inductors each having a first terminal coupled to a second terminal of a corresponding one of the plurality of capacitors and a second terminal;

a plurality of second inductors each having a first terminal coupled to the second terminal of a corresponding one of the plurality of capacitors and a second terminal;

a third switch coupled between second terminals of the plurality of first inductors and the display electrode; and a fourth switch coupled between second terminals of the plurality of second inductors and the display electrode.

18. The plasma display of claim 17, further comprising a resistor coupled between the second terminal of a first capacitor among the plurality of capacitors and the second terminal of a second capacitor among the plurality of capacitors.

19. The plasma display of claim 17, wherein a voltage of the display electrode increases when the third switch is turned on, and the voltage of the display electrode decreases when the fourth switch is turned on.

20. The plasma display of claim 17, wherein the third power source supplies a third voltage that is the same as the second voltage.

* * * * *